United States Patent [19]

Prijic

[11] Patent Number: 4,739,776

[45] Date of Patent: Apr. 26, 1988

[54] HAIR CURLING APPARATUS

[75] Inventor: Nevenka Prijic, Westmount, Canada

[73] Assignee: Philippe Lalande Designers Inc., Montreal, Canada

[21] Appl. No.: 923,103

[22] Filed: Oct. 24, 1986

[51] Int. Cl.[4] ..... A45D 8/00

[52] U.S. Cl. ..... 132/46 R; 132/9

[58] Field of Search ..... 132/31 R, 32 R, 46 R, 132/48 R

[56] References Cited

U.S. PATENT DOCUMENTS

| | | | |
|---|---|---|---|
| D. 145,893 | 11/1946 | Graham | 132/32 R |
| 257,784 | 5/1882 | Swartz | 132/31 R |
| 1,334,329 | 3/1920 | Taylor | 132/32 R |
| 1,471,881 | 10/1923 | Bové | 132/32 R |

*Primary Examiner*—Gregory E. McNeill
*Attorney, Agent, or Firm*—Samuel Meerkreebs

[57] ABSTRACT

A hair crimping apparatus comprises a modular tray having end edges and parallel side edges. The tray includes a series of corrugations including ridges and troughs extending laterally thereof and defined on one face thereof. Individual clamp rods corresponding to each trough on the face of the tray are pivoted to the side edges of the tray. The end edges of each tray terminate between a trough and a ridge, and a male and female mating connection is provided to connect the respective end edges of the modular trays so that the modular trays can be connected end to end so as to provide an extended tray with the same wave pattern.

8 Claims, 2 Drawing Sheets

HAIR CURLING APPARATUS

BACKGROUND OF THE INVENTION

1. Field of the Invention

The present invention relates to a hair crimping apparatus, and more particularly to an apparatus comprising molding tray with a sinusoidal hair receiving surface and a plurality of clamping rods adapted to clamp the hair in the tray for the purposes of setting multiple waves.

2. Description of the Prior Art

Several sinusoidal tray type curling devices exist in the prior art. Such devices are illustrated in Canadian patent No. 905,794, issued July 25, 1972 to H. Giles et al, and U.S. Pat. No. 1,622,798 issued Mar. 29, 1927 to V. J. Mougin, both of which show permanent wave making devices using the concept of the sinusoidal tray and a clamping device. German Offenlegungsschrift Nos. 27 53 980, W. Ehmann, laid open June 7, 1979, and 28 35 477, K. P. Ochs, laid open Feb. 21, 1980, show similar devices used for temporarily setting the hair as opposed to permanently setting the hair (commonly referred to as a "permanent").

When individual curling rods are used, the hair is wound starting from the free ends of the hair strands up to the scalp. Since the hair strands starting from the ends is curled over and over on the rod, the diameter increases as one reaches the scalp. Thus, the tightest curls are at the ends of the strands with the bigger curls near the scalp. The longer the hair, the more this is exaggerated. Big and loose hair curls near the scalp reduce the chance of hair retaining any "body" since these large loose curls will quickly flatten out. The sinusoidal tray device of the type mentioned above can be used to crimp small waves near the scalp to provide body. The size of the waves can be determined by selecting a tray having the proper sine pitch rather than by the length of hair.

However, when using a sinusoidal tray of the prior art, particularly the Giles et al and Ochs devices, damage to the hair can be caused when the strands of hair are forced into the valleys simultaneously by the clamping device. The hair strands are forced into the valleys and are thus stretched or otherwise slid forcefully around the clamping surfaces, thus damaging the hair strands. Furthermore, it would still be time consuming to set long hair. In order to avoid an interruption in the wave pattern being set, it would be necessary to set the hair strands in succession rather than all at once with several devices.

SUMMARY OF THE INVENTION

It is an aim of the present invention to provide a hair crimping apparatus which is an improved sinusoidal tray device whereby such trays can be connected end to end so as to provide a continuous wave setting device for long hair without interrupting the wave pattern.

It is also an aim of the present invention to provide an improved tray whereby the least possible damage will be caused to the hair.

A construction in accordance with the present invention comprises a modular tray of flexile material having end edges and parallel side edges. The modular tray includes a series of corrugations including ridges and troughs extending laterally of the tray on one face thereof. Individual clamp rods are pivoted to the side edge of the tray corresponding to each trough on the face of the tray. Each end edge of each modular tray, terminates between a trough and a ridge. Means are provided to connect the respective end edges of the modular trays whereby said modular trays can be connected end to end so as to provide an extended tray with the same wave pattern.

More specifically, the tray is provided with a ledge along the side edges on the surface thereof so as to guide the hair within the tray. The tray and clamp rods may also be provided with surface means for preventing side drifting of the hair strands.

Still more specifically, the corrugations have a smooth sine wave pattern.

BRIEF DESCRIPTION OF THE DRAWINGS

Having thus generally described the nature of the invention, reference will now be made to the accompanying drawings, showing by way of illustration, a preferred embodiment thereof, and in which.

DESCRIPTION OF THE PREFERRED EMBODIMENTS

Figure 1:
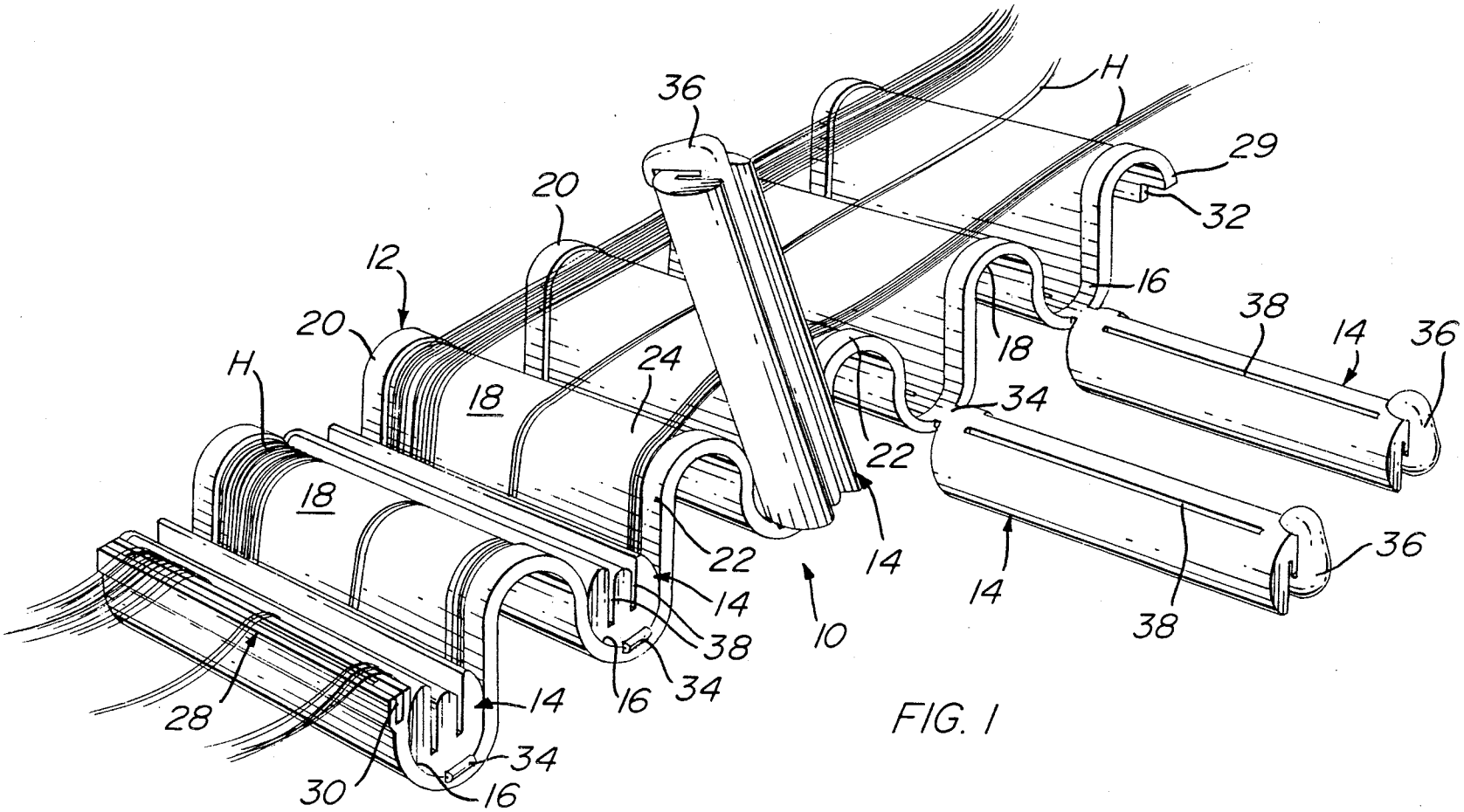
FIG. 1 is a perspective view of an embodiment in accordance with the present invention.

Referring now to the Figure a crimping apparatus 10 is illustrated in FIG. 1, having a tray 12 to which are hinged clamping rods 14. The clamping rods 14 are preferably made from a heat and chemical resistant material. The crimping apparatus 12, including the clamping rods 14 and the tray 12, can be injection molded in one piece. The tray would be about 3 inches wide and from 3 inches to 5½ inches in length. In fact the tray might be anywhere from 1½ inches wide and up. The dimensions of the device can be varied. The surface 24 may be textured to provide slipping of the hair strands.

The tray 12 has successive troughs 16 and ridges 18 in a smooth sine wave, presenting a smooth continuous surface 24. The side edges of the tray 12 are provided with ledges 20 and 22 in order to guide the hair strands and prevent them from sliding out of the tray 12.

Figure 4:
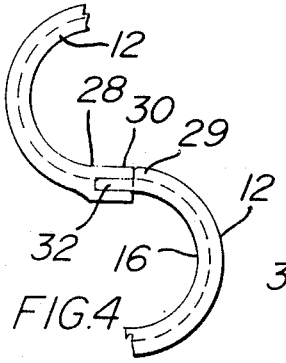
FIG. 4 is an enlarged fragmentary side elevation of a detail thereof.
Figure 5:
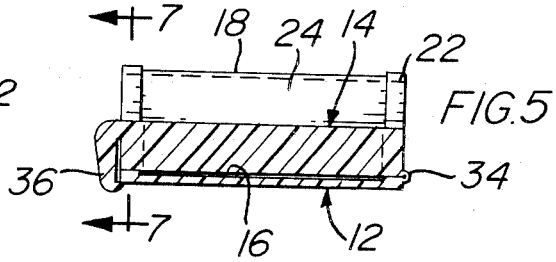
FIG. 5 is a vertical cross-section, taken along line 5—5 of FIG. 2.
Figure 3:
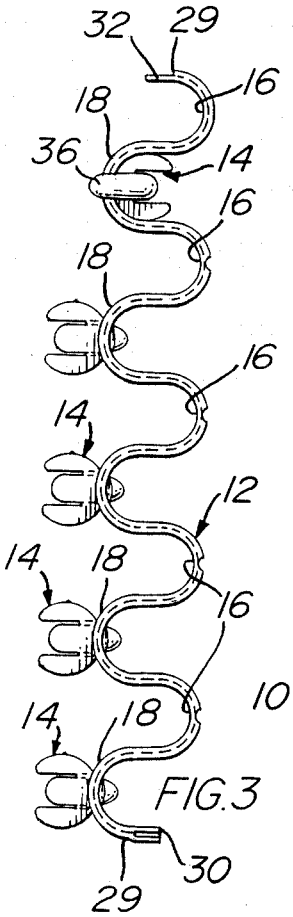
FIG. 3 is a side elevation view thereof.
Figure 2:
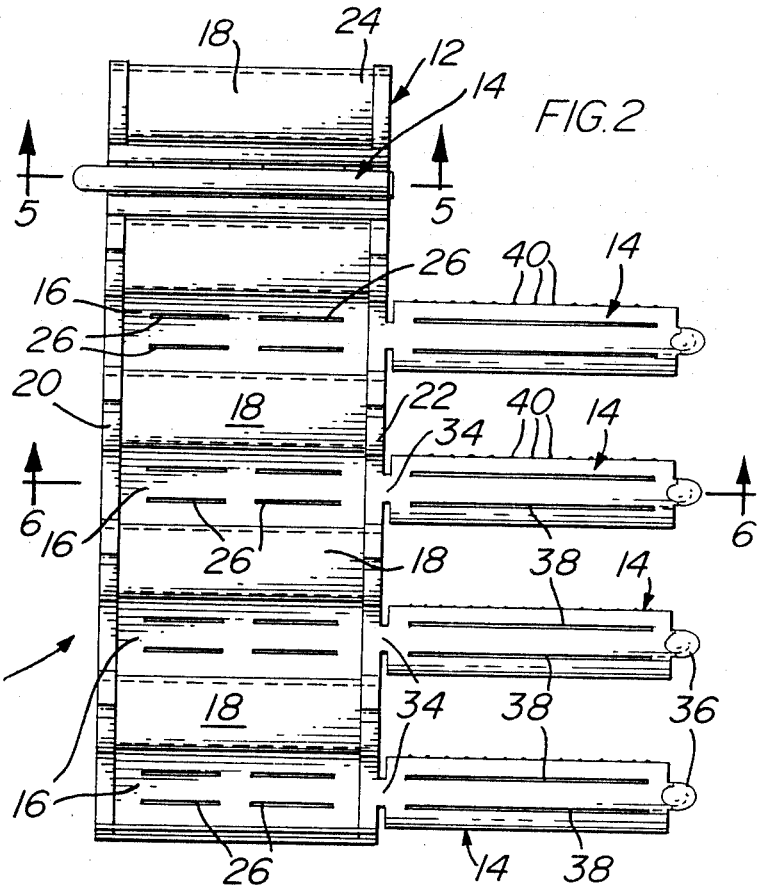
FIG. 2 is a top plan view thereof.
Figure 7:
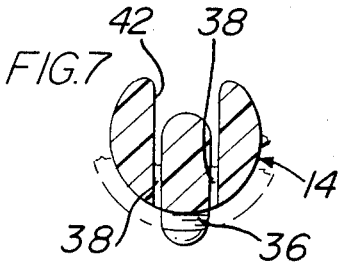
Figure 6:
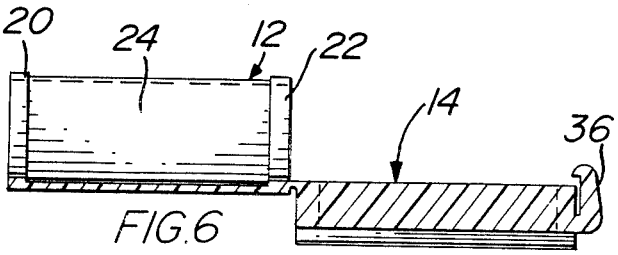
FIG. 6 is a vertical cross-section, taken along line 6—6 of FIG. 2; and, FIG. 7 is a vertical cross-section, taken along line 7—7 of FIG. 5.

The troughs 16 are provided with ventilation slits 26 as shown in FIG. 2. The tray also includes end edges 28 and 29. The end edge 28 terminates halfway between the bottom of the trough 16 and the peak of the ridge 18. It is adapted to be connected to the end 29 of another tray 10 and is provided in this case with a U-shaped female clip 30 extending along the end edge 28 and adapted to receive a male lip 32 provided along the opposite end edge 29. When the end edges are coupled together, as shown in FIG. 4, they form an uninterrupted sine wave similar to the sine wave patterns of the continuous surface 24.

Each clamp rod 14 is connected to the side edge of the tray 12 by means of living hinge 34 which, of course, is integrally molded therewith. The other end of the clamp rod 14 is provided with a snap lock clip 36 integrally molded therewith and adapted to clamp onto the opposite side edge of the tray 12. The clamp rod 14 is provided with an arcuate surface on one side thereof adapted to the curvature of the trough 16, and the other side thereof is provided with a recess 42 through which are defined ventilation slits 38. A plurality of short ribs 40 are provided along the surface of the clamp rods 14, and when the clamp rod 14 is closed within the trough 16, the ribs 40 abut against the continuous surface 24 and provide channels for the hair strands H to prevent the hair strands from drifting sideways between the clamp rods 14 and the surface 24 of the tray 12.

The ventilation slits 26 and 38 are anywhere from 1 to 2 inches long and 0.030 inches to 0.060 inches wide. These ventilation slits allow air to be passed therethrough to dry the hair. Treatment liquid passes therethrough to be absorbed by the hair.

In operation, a given length of tray is determined by the length of the hair strands to be set and a number of one to several modular crimping devices 10 are connected end to end by engaging the male lip 32 into the U-shaped female clip 30 at the respective end edges 29 and 28 of respective trays 12. The hair strands are then laid on the top of the ridges 18 of the tray 12, and the clamp rods 14 are pivoted one by one within the trough 16 and are closed so as to ensure that the hair strands are not caught or stretched. The clamp rods 14 would be set starting from the trough 16 of the tray 12 nearest the scalp, and the rods 14 are successively closed outwardly.

I claim:

1. A one-piece hair crimping apparatus comprising a modular tray having end edges and parallel side edges, the tray including a series of continuous corrugations including ridges and troughs extending laterally thereof and defined on one face thereof, individual clamp rods corresponding to each trough on said face of the tray, pivoted to a side edge of the tray, the end edges of each tray terminating between a trough and a ridge, the tray and clamp rods being molded integrally of plastic material and the clamp rods are pivotally connected to the side edge of the tray by a living hinge while the other end of the rod includes an integral snap lock clip for engaging the opposite side edge, and means are provided to connect the respective end edges of the modular trays whereby said modular trays can be connected end to end so as to provide an extended tray with the same wave pattern.

2. A hair crimping apparatus as defined in claim 1, wherein the tray is provided with a ledge along the side edges on the surface thereof so as to guide the hair within the tray.

3. A hair crimping apparatus as defined in claim 2, wherein the tray and clamp rods are also provided with surface means for preventing side drifting of the hair strands.

4. A hair crimping apparatus as defined in claim 1, wherein the successive troughs and ridges forming the corrugations have the form of a smooth sine wave pattern.

5. A hair crimping apparatus as defined in claim 4, wherein the clamp rods have an arcuate surface adapted to the shape of the trough.

6. A hair crimping apparatus as defined in claim 1, wherein the clamp rods and the trough are provided with ventilation slits.

7. A hair crimping apparatus as defined in claim 1, wherein the corrugated surface is textured in order to provide frictional resistance to the hair strands from moving sideways in the tray.

8. A hair crimping apparatus as defined in claim 3, wherein the arcuate surface of the clamp rods is provided with a plurality of short ribs adapted to form channels with the surface of the trough to thereby prevent the hair strands from drifting sideways.

* * * * *